US009550647B1

(12) United States Patent
Flynn et al.

(10) Patent No.: US 9,550,647 B1
(45) Date of Patent: Jan. 24, 2017

(54) SELF-SETTING EXIT ROLL ASSEMBLY

(71) Applicant: Xerox Corporation, Norwalk, CT (US)

(72) Inventors: Neil Flynn, Henlow (GB); Stephen May, Hitchin (GB); Roy Gladwin, Aylesbury (GB); Daniel J. Geoghegan, Harpenden (GB); Jeffrey W. Ryan, Knebworth (GB); Kaarthikeyan Seetharaman, Chennai (IN)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/883,087

(22) Filed: Oct. 14, 2015

(51) Int. Cl.
*B65H 29/12* (2006.01)
*B65H 29/58* (2006.01)

(52) U.S. Cl.
CPC ..... *B65H 29/125* (2013.01); *B65H 29/12* (2013.01); *B65H 29/58* (2013.01); *B65H 2404/144* (2013.01); *B65H 2404/14211* (2013.01); *B65H 2404/1521* (2013.01)

(58) Field of Classification Search
CPC ..... B65H 29/12; B65H 2404/142; B65H 2404/1421; B65H 2404/14211; B65H 2404/15; B65H 2404/152; B65H 2404/1521; B65H 2404/1522
See application file for complete search history.

(56) References Cited

U.S. PATENT DOCUMENTS 3,848,788 A 11/1974 Buta
5,014,976 A 5/1991 Muck et al.
5,201,517 A 4/1993 Stemmle
5,210,616 A * 5/1993 Kawasaki ..... B65H 5/26 271/11
5,215,298 A * 6/1993 Stemmle ..... B65H 29/14 271/186
5,273,273 A 12/1993 Xydias
5,601,281 A 2/1997 Kubodera et al.
6,390,287 B2 5/2002 Riffe
6,431,397 B1 8/2002 Fishman
6,663,099 B2 12/2003 Inoue
7,244,072 B2 7/2007 Hawver et al.
7,637,490 B2 12/2009 Kapturowski et al.
7,823,878 B2 * 11/2010 Su ..... B41J 3/60 271/184
8,328,195 B2 12/2012 Rosacker et al.
8,406,666 B2 3/2013 Mikutsu
8,876,111 B1 * 11/2014 Lan ..... B65H 5/06 271/273
8,998,206 B2 * 4/2015 Hiyama ..... B65H 29/58 271/272

(Continued)

*Primary Examiner* — Patrick Cicchino
(74) *Attorney, Agent, or Firm* — Gibb & Riley, LLC

(57) ABSTRACT

Devices have a movable roller, a fixed-position roller contacting the movable roller to form an exit nip transporting planar media, biasing members operatively connected to the movable roller, and adjusters contacting the movable roller. Such devices are connectable to a first machine or a second machine. Contact areas of the first machine hold the adjusters in a first position to position the movable roller in a position resulting in the exit nip transporting the planar media in a first exit direction. The second machine instead has void areas positioned to allow movement of the adjusters to position the movable roller in a position resulting in the exit nip transporting the planar media in a second exit direction different from the first exit direction.

20 Claims, 4 Drawing Sheets

(56) References Cited

U.S. PATENT DOCUMENTS

| | | | | |
|---|---|---|---|---|
| 9,132,979 | B1 * | 9/2015 | Moore | B65H 15/00 |
| 2009/0190983 | A1 * | 7/2009 | Yamamoto | B65H 29/12 399/406 |
| 2010/0025928 | A1 * | 2/2010 | Yamamoto | B65H 29/14 271/302 |
| 2014/0203059 | A1 | 7/2014 | Wegele et al. | |
| 2014/0306396 | A1 * | 10/2014 | Lan | B65H 5/06 271/3.19 |
| 2015/0274472 | A1 * | 10/2015 | Momiyama | B65H 29/70 271/207 |
| 2015/0344254 | A1 * | 12/2015 | Sugitani | B65H 29/14 271/176 |

* cited by examiner

SELF-SETTING EXIT ROLL ASSEMBLY

BACKGROUND

Devices herein generally relate to those that utilize rollers to form nips for transporting sheets of media, and more particularly to components that have nips that direct sheets of media to exit a device.

Complex machines are formed of many diverse components, and often many individual components are combined into assemblies that perform a specific function. Assemblies can be interchangeably used in different device models, which adds efficiency to manufacturing operations.

In one example of an assembly, two or more flat, elongated rolls or rollers (at least one of which is driven) are positioned in a sheet feeding assembly to be in contact so as to form a nip that drives flat items, such as continuous-feed webs, or cut sheets, of print media (paper, transparencies, plastic, metal, cloth, etc.). An exit roll assembly (e.g., an offset shuttle roll assembly) is often used as a component of a larger machine, such as a printer, copier, scanner, multi-function printing device, etc., to perform the function of causing printed flat print media to exit the larger sheet-handling machine.

However, sometimes a sheet-handling machine can produce sheets that exit to more than one type of device. In one example, the sheets exiting a printing device can be driven by the nip of an exit roll assembly to a finisher transport (FT) device or a center tray (CT) device. Sheets are fed to finisher transport device at a different angle from sheets that are fed to a center tray device and, therefore, different offset shuttle roll assemblies are sometimes used in the same model sheet handling device based on whether that sheet handling device will be connected to a finisher transport device or a center tray device.

The proliferation of different types of assemblies adds complexity, and can result in the wrong type of assembly being utilized. Incorrect assembly usage prevents proper device operation, which wastes time and device resources and decreases user satisfaction.

SUMMARY

Exemplary apparatuses herein include, among other components, a movable roller, a fixed-position roller contacting the movable roller to form an exit nip transporting planar media, biasing members operatively (meaning directly or indirectly) connected to the movable roller, and adjusters contacting the movable roller.

The biasing members force the movable roller in a first direction relative to the fixed-position roller to move the movable roller from a first position to a second position. The adjusters move from the first position to the second position with the movable roller. The movable roller contacts the fixed-position roller in both the first position and the second position. The apparatus are connectable to a first machine or a second machine.

The first machine has contact areas positioned to contact the adjusters when the apparatus is connected to the first machine. The contact areas hold the adjusters in the first position when the apparatus is connected to the first machine to position the movable roller in the first position resulting in the exit nip transporting the planar media in a first exit direction. The second machine instead has void areas positioned to allow movement of the adjusters in the first direction when the apparatus is connected to the second machine. The void areas allow the biasing members to position the adjusters in the second position when the apparatus is connected to the second machine to position the movable roller in the second position resulting in the exit nip transporting the planar media in a second exit direction different from the first exit direction.

Different exemplary apparatuses (e.g., such as an offset shuttle roll assembly) herein include, among other components, a movable roller, a fixed-position roller contacting the movable roller to form an exit nip transporting planar media, movable mounting features connected to the movable roller, fixed mounting features connected to the fixed-position roller, biasing members connected to the movable mounting features, and adjusters (e.g., such as plungers) contacting the movable mounting features. The movable roller has a first axle connected to the movable mounting features about which the movable roller rotates and the fixed-position roller has a second axle connected to the fixed mounting features about which the fixed-position roller rotates. Additionally, the apparatuses can include a motor, connected to or as part of the fixed mounting features that rotate the fixed-position roller.

The biasing members force the movable mounting features in a first direction relative to the fixed mounting features, and the biasing members move the movable roller from a first position to a second position in the first direction by moving the movable mounting features. Both the movable mounting features and the adjusters move from the first position to the second position with the movable roller. The movable roller contacts the fixed-position roller in both the first position and the second position.

The apparatus can be connected to a first machine (e.g., such as a center-tray machine) or a second machine (e.g., such as a finisher transport machine). The first machine has a different processing function from the second machine. Such structures can further include mounting points connecting the apparatus to the first machine and the second machine. The first machine and the second machine have identical receptor points connected to the mounting points, so the apparatus can easily be connected to either the first or second machine using the same mounting point and receptor point locations.

The first machine has contact areas positioned to contact the adjusters when the apparatus is connected to the first machine. The contact areas hold the adjusters in the first position against biasing forces exerted by the biasing members. Such contact areas hold the adjusters in the first position when the apparatus is connected to the first machine to position the movable roller in the first position, which results in the exit nip transporting the planar media in a first exit direction.

The second machine instead has void areas positioned to allow movement of the adjusters in the first direction when the apparatus is connected to the second machine. These void areas allow the biasing members to position the adjusters in the second position when the apparatus is connected to the second machine to position the movable roller in the second position, which results in the exit nip transporting the planar media in a second exit direction different from the first exit direction.

More specifically, the first exit direction is at a first angle relative to and outward from the planar exterior surface of the apparatus. The second exit direction is at a second angle relative to and outward from the planar exterior surface. The first angle is different from the second angle.

These and other features are described in, or are apparent from, the following detailed description.

BRIEF DESCRIPTION OF THE DRAWINGS

Various exemplary devices are described in detail below, with reference to the attached drawing figures, in which.

DETAILED DESCRIPTION

As mentioned above, sheets are fed to finisher transport (FT) device at a different angle from sheets that are fed to a center tray (CT) device (e.g., 0 degrees and 20 degrees respectively) and, therefore, different offset shuttle roll assemblies are used in sheet handling devices based on whether the sheet handling device will be connected to a finisher transport device or a center tray device. However, incorrect assembly usage prevents proper device operation, which wastes time and device resources and decreases user satisfaction.

Instead of having different assemblies for different post-sheet exit configurations, the devices herein incorporate multiple sheet exit angle exit positions in a single type of self-setting/adjusting assembly. This allows only one type of assembly to be manufactured, and no further change of that assembly is made, regardless of the type of post-printing processing device that is connected to the large printing machine maintaining the assembly.

In one non-limiting example, instead of having different offset roll assemblies for use with finisher transport and center tray post-printing devices, the assemblies herein incorporate both positions (0 and 20 degrees) in a self-setting/adjusting roll assembly mechanism so that only one type of roll assembly is manufactured, and no further change of that roll assembly is made, regardless of whether the large machine maintaining the assembly is fitted to a finisher transport or center tray unit. While offset roll assemblies, finisher transport devices, and center tray devices are used in the examples herein, those ordinarily skilled in the art would understand that the features described herein are to be used with any type of driven-nip sheet-handling assembly and such structures are not limited to being used only with offset roll assemblies, finisher transport devices, center tray devices, etc.

Having different assemblies wastes installation time, and also leaves open the potential of incorrect assembly fitment by the rigger. However with the single self-setting assemblies described herein (that are added to the machine during original manufacture at the factory, and are not later fitted by an in-field rigger) many types of post-printing devices can be attached to a printing machine in the field by the rigger, without any adjustment of the sheet exit assembly being performed in the field because the sheet exit assemblies described herein self-set to the correct angle.

With sheet exit assemblies described herein, for example, in center tray mode, the roll assembly is outwardly sprung at a 20 degree angle position, sending the output sheets upwards by 20 degrees on the exit into a tray. However, in finisher transport mode is to be fitted, the roll assembly is located with pressure exerted against two plungers, which push the sprung loaded roll assembly back to a stop, which leaves the rolls at a zero degree angle.

Figure 1:
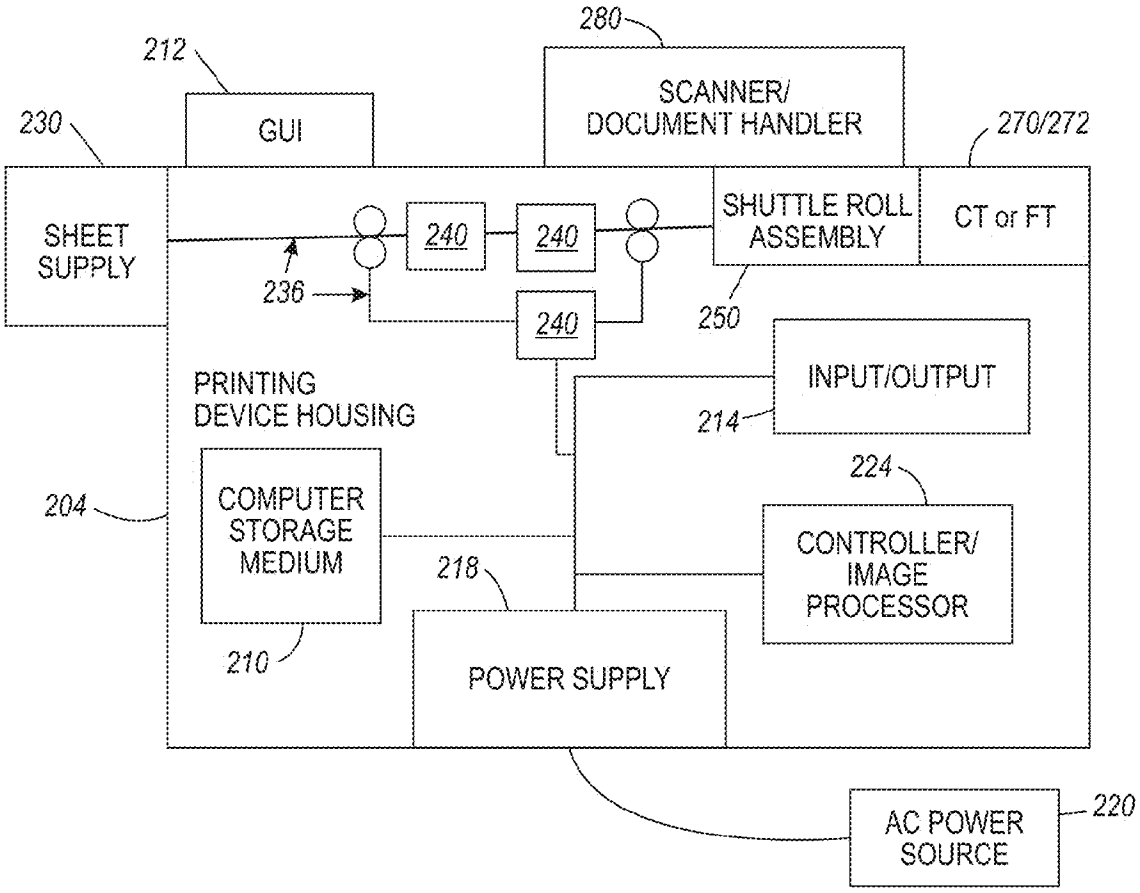
FIG. 1 is a schematic diagram illustrating devices herein.

FIG. 1 illustrates a printing device 204, which can be used with devices herein and can comprise, for example, a printer, copier, multi-function machine, multi-function device (MFD), etc. The printing device 204 includes a controller/tangible processor 224 and a communications port (input/output) 214 operatively connected to the tangible processor 224 and to the computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 1, a body housing has one or more functional components that operate on power supplied from an alternating current (AC) source 220 by the power supply 218. The power supply 218 can comprise a common power conversion unit, power storage element (e.g., a battery, etc), etc.

The printing device 204 also includes at least one marking device (printing engine(s)) 240 operatively connected to a specialized image processor 224 (that is different from a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher which can fold, staple, sort, etc., the various printed sheets. Also, the printing device 204 can include at least one accessory functional component (such as a scanner/document handler 280 (automatic document feeder (ADF)), etc.) that also operate on the power supplied from the external power source 220 (through the power supply 218).

The one or more printing engines 240 are intended to illustrate any marking device that applies a marking material (toner, inks, etc.) to continuous media or sheets of media, whether currently known or developed in the future and can include, for example, devices that use a photoreceptor belt or an intermediate transfer belt, or devices that print directly to print media (e.g., inkjet printers, ribbon-based contact printers, etc.).

Additionally, FIG. 1 illustrates different machines connected to the printer 204 that receive printed sheets from a shuttle roll assembly 250 of the printer, and such machines can include, for example, a first machine 270 (e.g., such as a center-tray machine) or a second machine 272 (e.g., such as a finisher transport machine), etc.

Figure 2:
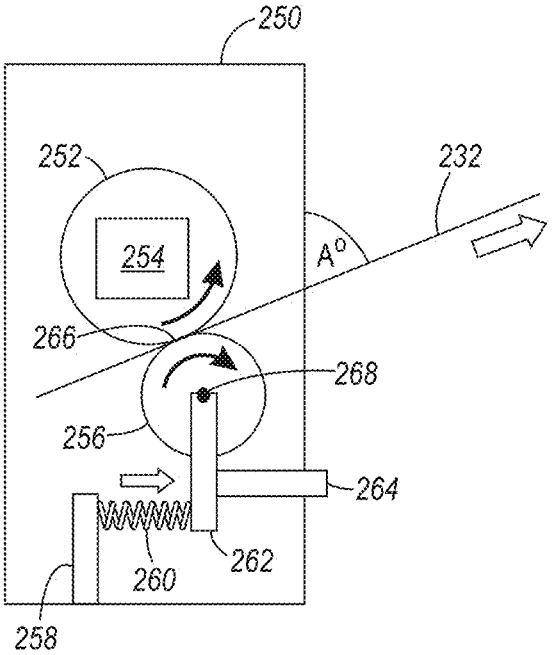
FIG. 2 is a schematic diagram illustrating devices herein.
Figure 3:
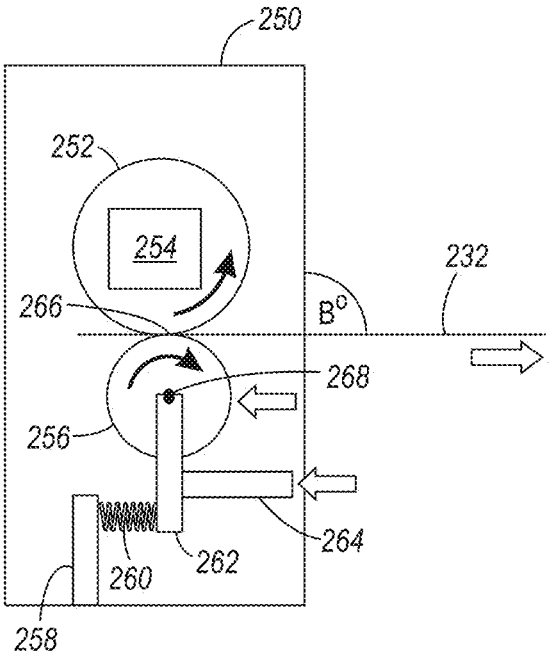
FIG. 3 is a schematic diagram illustrating devices herein.

As shown in greater detail in FIGS. 2-3, the apparatus(es) 250 shown in FIG. 1 (e.g., such as an offset shuttle roll assembly 250) include, among other components, a moveable roller 256, a fixed-position roller 252 contacting the moveable roller 256 to form an exit nip 266 transporting planar media 232, movable mounting feature(s) 262 connected to the moveable roller 256, fixed mounting feature(s) 254 connected to the fixed-position roller 252, biasing member(s) 260 (such as springs, elastic bands, pistons, biased beams, actuators, magnetic structures, electrically biased structures, etc.) connected to fixed mounting points 258 and the movable mounting features 262, and adjuster(s) 264 (e.g., such as (hollow or solid) plungers, cylinders, rods, needles, beams, posts, arms, connectors, etc.) contacting the movable mounting features 262.

The moveable roller 256 has a first axle 268 connected to the movable mounting features 262 about which the moveable roller 256 rotates (as shown by the block arrow in the drawing) and the fixed-position roller 252 has a second axle 254 connected to the fixed mounting features 254 about which the fixed-position roller 252 rotates (as also shown by the block arrow in the drawing) to move the media sheet 232 in the direction shown by the block arrow. Additionally, the second axle can include or be attached to a motor (that is connected to or is part of the fixed mounting features) that rotates the fixed-position roller 252; and for ease of illustration the fixed mounting feature, second axle, and motor are represented in the drawing as a single item 254.

FIGS. 2 and 3 illustrate the same offset shuttle roll assembly 250; however, in FIG. 3 the biasing member 260 is compressed, while in FIG. 2 the biasing member 260 is expanded which moves the movable mounting features 262, the adjusters 264, and the movable roller 256. Thus, the biasing members 260 force the movable mounting features 262 in a first direction (shown by the block arrow in FIG. 2) relative to the fixed mounting features 254. As shown, the biasing members 260 move the moveable roller 256 from a first position (shown in FIG. 3) to a second position (shown in FIG. 2) in a first direction (block arrow, FIG. 2) by moving the movable mounting features 262. Both the movable mounting features 262 and the adjusters 264 move from the first position (FIG. 3) to the second position (FIG. 2) with the moveable roller 256. The moveable roller 256 contacts the fixed-position roller 252 in both the first position (FIG. 3) and the second position (FIG. 2).

Figure 4:
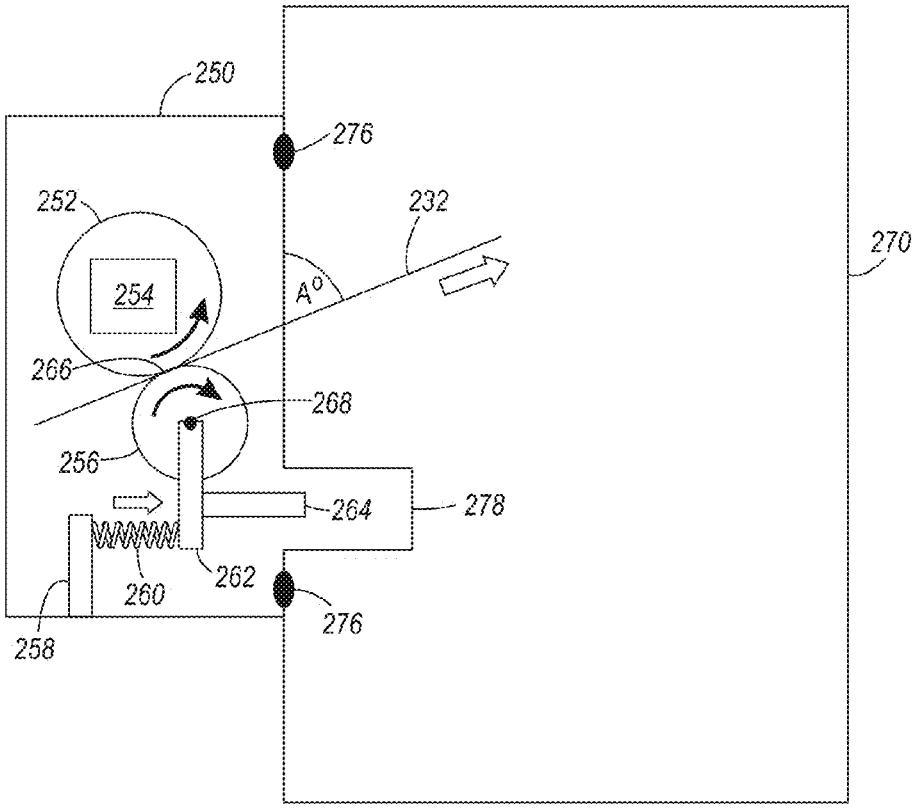
FIG. 4 is a schematic diagram illustrating devices herein.
Figure 5:
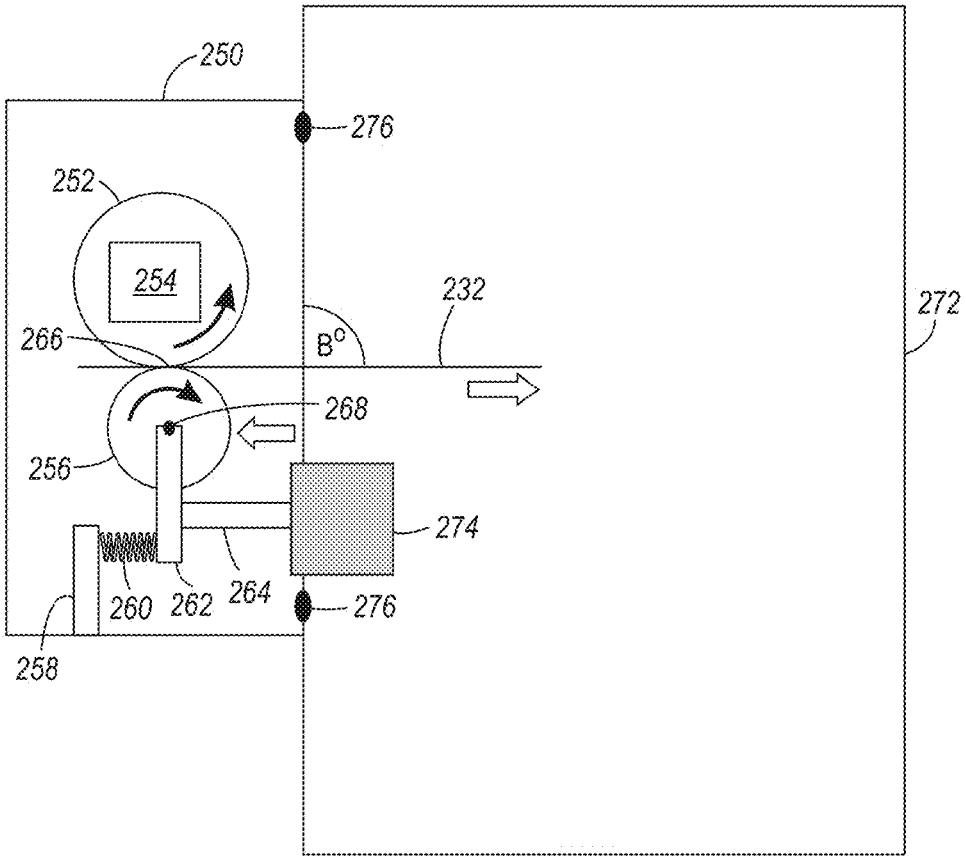
FIG. 5 is a schematic diagram illustrating devices herein.

FIGS. 4 and 5 illustrate the same offset shuttle roll assembly 250; however, in FIG. 4 the offset shuttle roll assembly 250 is connected to a center-tray machine that requires planar media 232 be supplied at an upward angle (A°), while in FIG. 5 the offset shuttle roll assembly 250 is connected to a finisher transport machine that requires planar media 232 be supplied at a flat angle (B°). More specifically, a first exit direction at which the planar media 232 exits nip 266 is at a first angle relative to (and outward from) the planar exterior surface of the offset shuttle roll assembly 250 (e.g., upward angle (A°)) as shown in FIGS. 2 and 4, and can be for example, any angle other than approximately 85°-95° (e.g., can be 0°-84° or 96°-180°). Also, a second exit direction at which the planar media 232 exits nip 266 is at a second different angle relative to (and outward from) the planar exterior surface of the offset shuttle roll assembly 250 (e.g., flat angle (B°)) as shown in FIGS. 3 and 5, and can be for example, approximately 85°-95°. In other offset shuttle roll assemblies 250 herein, the first and second exit directions can be any angles (0°-180°) relative to the planar exterior surface of the offset shuttle roll assembly 250, so long as the first and second exit directions are different by at least a minimum angular difference (e.g., 10°, 15°, 30°, 45° difference in angles A° and B°).

Thus, as shown in FIGS. 4-5, the offset shuttle roll assembly 250 can be connected to a first machine 270 (e.g., such as a center-tray machine) or a second machine 272 (e.g., such as a finisher transport machine) without modifying the offset shuttle roll assembly 250 in any way. The first machine 270 and the second machine 272 can be any types of machines that have different processing functions and/or that require planar media 232 be supplied at different angles.

Such structures can further include mounting points 276 connecting the offset shuttle roll assembly 250 to the first machine 270 and the second machine 272. The first machine 270 and the second machine 272 have identical receptor points (also shown using identification numeral 276) connected to the mounting points 276, so the offset shuttle roll assembly 250 can easily be connected to either the first or second machine using the same mounting point and receptor point locations 276.

As shown in FIG. 4, the first machine 270 has void areas 278 positioned to allow movement of the adjusters 264 in the first direction (as shown by the block arrows in FIG. 4) when the offset shuttle roll assembly 250 is connected to the first machine 270. These void areas 278 allow the biasing members 260 to position the adjusters 264 in the second position (FIG. 4) when the offset shuttle roll assembly 250 is connected to the first machine 270 to also position the moveable roller 256 in the second position (FIG. 4), which results in the exit nip 266 transporting the planar media 232 in the second exit direction (e.g., upward angle (A°)).

As shown in FIG. 5, the second machine 272 has contact areas 274 positioned to contact the adjusters 264 when the offset shuttle roll assembly 250 is connected to the second machine 272. The contact areas 274 hold the adjusters 264 in the first position (FIG. 5) against biasing forces exerted by the biasing members 260, as shown by the block arrow in FIG. 5. Such contact areas 274 hold the adjusters 264 in the first position (FIG. 5) when the offset shuttle roll assembly 250 is connected to the second machine 272 to position the moveable roller 256 in the first position (FIG. 5), which results in the exit nip 266 transporting the planar media 232 in the first exit direction (e.g., flat angle (B°)) that is different from the second exit direction.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the devices described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The devices herein can encompass devices that print in color, monochrome, or handle color or monochrome image data. All foregoing devices are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user); one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices herein cannot be implied or imported from any above example as limitations to any particular order, number, position, size, shape, angle, color, or material.

What is claimed is:

1. An apparatus comprising:

a movable roller;

a fixed-position roller contacting said movable roller to form an exit nip transporting planar media;

biasing members operatively connected to said movable roller; and adjusters contacting said movable roller, said biasing members forcing said movable roller in a first direction relative to said fixed-position roller to move said movable roller from a first position to a second position, said adjusters moving from said first position to said second position with said movable roller, said movable roller contacting said fixed-position roller in both said first position and said second position, said apparatus being connectable to a first machine or to a second machine, said first machine having contact areas positioned to contact said adjusters when said apparatus is connected to said first machine, said contact areas holding said adjusters in said first position when said apparatus is connected to said first machine to position said movable roller in said first position resulting in said exit nip transporting said planar media in a first exit direction, said second machine having void areas positioned to allow movement of said adjusters in said first direction when said apparatus is connected to said second machine, and said void areas allowing said biasing members to position said adjusters in said second position when said apparatus is connected to said second machine to position said movable roller in said second position resulting in said exit nip transporting said planar media in a second exit direction different from said first exit direction.

2. The apparatus according to claim 1, further comprising a planar exterior surface, said first exit direction being at a first angle relative to and outward from said planar exterior surface, said second exit direction being at a second angle relative to and outward from said planar exterior surface, and said first angle being different from said second angle.

3. The apparatus according to claim 1, said contact areas holding said adjusters in said first position against biasing forces exerted by said biasing members.

4. The apparatus according to claim 1, said first machine having a different processing function from said second machine.

5. The apparatus according to claim 1, said movable roller having a first axle connected to movable mounting features about which said movable roller rotates, and said fixed-position roller having a second axle connected to fixed mounting features about which said fixed-position roller rotates.

6. The apparatus according to claim 1, further comprising mounting points connecting said apparatus to said first machine and said second machine, and said first machine and said second machine having identical receptor points connectable to said mounting points.

7. The apparatus according to claim 1, further comprising a motor rotating said fixed-position roller.

8. An apparatus comprising:

a movable roller;

a fixed-position roller contacting said movable roller to form an exit nip transporting planar media;

movable mounting features connected to said movable roller;

fixed mounting features connected to said fixed-position roller;

biasing members connected to said movable mounting features; and adjusters contacting said movable mounting features, said biasing members forcing said movable mounting features in a first direction relative to said fixed mounting features, said biasing members moving said movable roller from a first position to a second position in said first direction by moving said movable mounting features, said movable mounting features and said adjusters moving from said first position to said second position with said movable roller, said movable roller contacting said fixed-position roller in both said first position and said second position, said apparatus being connectable to a first machine or to a second machine, said first machine having contact areas positioned to contact said adjusters when said apparatus is connected to said first machine, said contact areas holding said adjusters in said first position when said apparatus is connected to said first machine to position said movable roller in said first position resulting in said exit nip transporting said planar media in a first exit direction, said second machine having void areas positioned to allow movement of said adjusters in said first direction when said apparatus is connected to said second machine, and said void areas allowing said biasing members to position said adjusters in said second position when said apparatus is connected to said second machine to position said movable roller in said second position resulting in said exit nip transporting said planar media in a second exit direction different from said first exit direction.

9. The apparatus according to claim 8, further comprising a planar exterior surface, said first exit direction being at a first angle relative to and outward from said planar exterior surface, said second exit direction being at a second angle relative to and outward from said planar exterior surface, and said first angle being different from said second angle.

10. The apparatus according to claim 8, said contact areas holding said adjusters in said first position against biasing forces exerted by said biasing members.

11. The apparatus according to claim 8, said first machine having a different processing function from said second machine.

12. The apparatus according to claim 8, said movable roller having a first axle connected to said movable mounting features about which said movable roller rotates, and said fixed-position roller having a second axle connected to said fixed mounting features about which said fixed-position roller rotates.

13. The apparatus according to claim 8, further comprising mounting points connecting said apparatus to said first machine and said second machine, and said first machine and said second machine having identical receptor points connectable to said mounting points.

14. The apparatus according to claim 8, further comprising a motor rotating said fixed-position roller.

15. An offset shuttle roll assembly comprising:

a movable roller;

a fixed-position roller contacting said movable roller to form an exit nip transporting planar media;

movable mounting features connected to said movable roller;

fixed mounting features connected to said fixed-position roller;

springs connected to said movable mounting features; and plungers contacting said movable mounting features, said springs forcing said movable mounting features in a first direction relative to said fixed mounting features, said springs moving said movable roller from a first position to a second position in said first direction by moving said movable mounting features, said movable mounting features and said plungers moving from said first position to said second position with said movable roller, said movable roller contacting said fixed-position roller in both said first position and said second position, said offset shuttle roll assembly being connectable to a center-tray machine or to a finisher transport machine, said center-tray machine having contact areas positioned to contact said plungers when said offset shuttle roll assembly is connected to said center-tray machine, said contact areas holding said plungers in said first position when said offset shuttle roll assembly is connected to said center-tray machine to position said movable roller in said first position resulting in said exit nip transporting said planar media in a first exit angle from said offset shuttle roll assembly, said finisher transport machine having void areas positioned to allow movement of said plungers in said first direction when said offset shuttle roll assembly is connected to said finisher transport machine, and said void areas allowing said springs to position said plungers in said second position when said offset shuttle roll assembly is connected to said finisher transport machine to position said movable roller in said second position resulting in said exit nip transporting said planar media in a second exit angle from said offset shuttle roll assembly different from said first exit angle from said offset shuttle roll assembly.

16. The offset shuttle roll assembly according to claim 15, further comprising a planar exterior surface, said first exit angle from said offset shuttle roll assembly being at a first angle relative to and outward from said planar exterior surface, said second exit angle from said offset shuttle roll assembly being at a second angle relative to and outward from said planar exterior surface, and said first angle being different from said second angle.

17. The offset shuttle roll assembly according to claim 15, said contact areas holding said plungers in said first position against biasing forces exerted by said springs.

18. The offset shuttle roll assembly according to claim 15, said center-tray machine having a different processing function from said finisher transport machine.

19. The offset shuttle roll assembly according to claim 15, said movable roller having a first axle connected to said movable mounting features about which said movable roller rotates, and said fixed-position roller having a second axle connected to said fixed mounting features about which said fixed-position roller rotates.

20. The offset shuttle roll assembly according to claim 15, further comprising mounting points connecting said offset shuttle roll assembly to said center-tray machine and said finisher transport machine, and said center-tray machine and said finisher transport machine having identical receptor points connectable to said mounting points.

* * * * *